United States Patent [19]

Lee

[11] Patent Number: 4,744,145

[45] Date of Patent: May 17, 1988

[54] HAIR PARTING AND GRASPING CUTTER

[76] Inventor: Ben G. Lee, 2136 Weatherly Pl., Fullerton, Calif. 92633

[21] Appl. No.: 947,840

[22] Filed: Dec. 31, 1986

Related U.S. Application Data

[63] Continuation-in-part of Ser. No. 913,962, Oct. 1, 1986.

[51] Int. Cl.[4] ..... B26B 13/00

[52] U.S. Cl. ..... 30/134; 30/253; 30/258

[58] Field of Search ..... 30/30, 124, 134, 258, 30/234, 175, 176, 195

[56] References Cited

U.S. PATENT DOCUMENTS

| | | | |
|---|---|---|---|
| 168,794 | 10/1875 | Sidle | 30/258 X |
| D. 250,629 | 12/1978 | Backstrom et al. | 30/253 X |
| 340,053 | 4/1886 | Lytle | 30/253 |
| 1,284,993 | 11/1918 | Bellman | 30/258 X |
| 1,445,057 | 2/1923 | Angeletti | 30/197 |
| 2,288,299 | 6/1942 | Pileggi | 30/30 |
| 2,738,579 | 3/1956 | Gent | 30/30 |
| 3,029,509 | 4/1962 | Peters | 30/30 |
| 4,020,549 | 3/1977 | Edwards | 30/30 |
| 4,058,891 | 11/1977 | Spanel | 30/30 |
| 4,146,960 | 4/1979 | Flowers | 30/195 |

*Primary Examiner*—Douglas D. Watts

[57] ABSTRACT

A hair parting and grasping cutter providing means for parting, grasping, lifting and cutting a person's hair conveniently by one hand operation, comprises a frame (20), an upper shear (40), an upper shear casing (60) and a lower shear (70). The elongated upper and lower portions of the frame each comprises in sequence of a front portion (22, 32), an arm portion (24, 34) with a slot (23, 33), a handle portion (26, 36) and a spring portion (28, 38) which is joined to a rear end (30) of the frame, so as to be closed each other to grasp the hair by the squeezing strength of a user's hand onto the handle portions. The sharp ended front portions are inserted to the hair to part the desired section of the hair. The upper shear casing is fixedly attached to the upper arm portion within the upper slot, and the upper shear is pivotably attached to near the front end of the upper shear casing. A spring strip (66) to force the upper shear upwardly and an upperwall (64) to stop the upper shear are one-piece body with the upper shear casing. The lower shear is fixedly attached to the lower arm portion within the lower slot. An actuator (70) pivotably attached to the rear of the upper shear has a spring strip (56) projected from an upperwall (54) of the actuator to force the rear end of the actuator downwardly. By pressing the top of the actuator with a tip of a finger of the same hand, the blade cutting edges of the shears are contacted and overlapped each other to cut the hair.

6 Claims, 3 Drawing Sheets

HAIR PARTING AND GRASPING CUTTER

BACKGROUND OF THE INVENTION

The hair parting and grasping cutter is a continuation-in-part of Ser. No. 913,962, filed Oct. 1, 1986.

The customary practice for a hair designer cutting hair is to first part the desired section of the hair, grasp the parted section of the hair with the first and second fingers of one hand, lift the grasping hand up to the position to be cutted, and finally cut the hair with the other hand holding a cutting tool. Numerous hand manipulated devices have heretofore been developed for some of the above words, however, many of these devices are suffer from lack of the practical uses thereof.

In accordance with the present invention, the hair parting and grasping cutter is advantageously provided to facilitate the forementioned works, such as parting, grasping, lifting and cutting the hair by one hand opertion (either a right or left hand). This hair cutter, therefore, saves time in repeated process of the above works, performs better quality of such works requiring less skill to perform the same works, and also is safe from handcut by the cutting blades. Since one hand is free during the above process, such free hand can be adapted to satisfy the various styling needs with or without other tools. This hair cutter is small in size, light in weight and handy with the handles so as to provide convenient uses thereof. In addition, the operation of this hair cutter is so simple and easy that it can be used by the most novices and professioals for others and even for themselves. Futher objects and advantages of this invention will become apparent from a consideration of the ensuing description and accompanying drawings.

DRAWING REFERENCE NUMERALS

Figure 1:
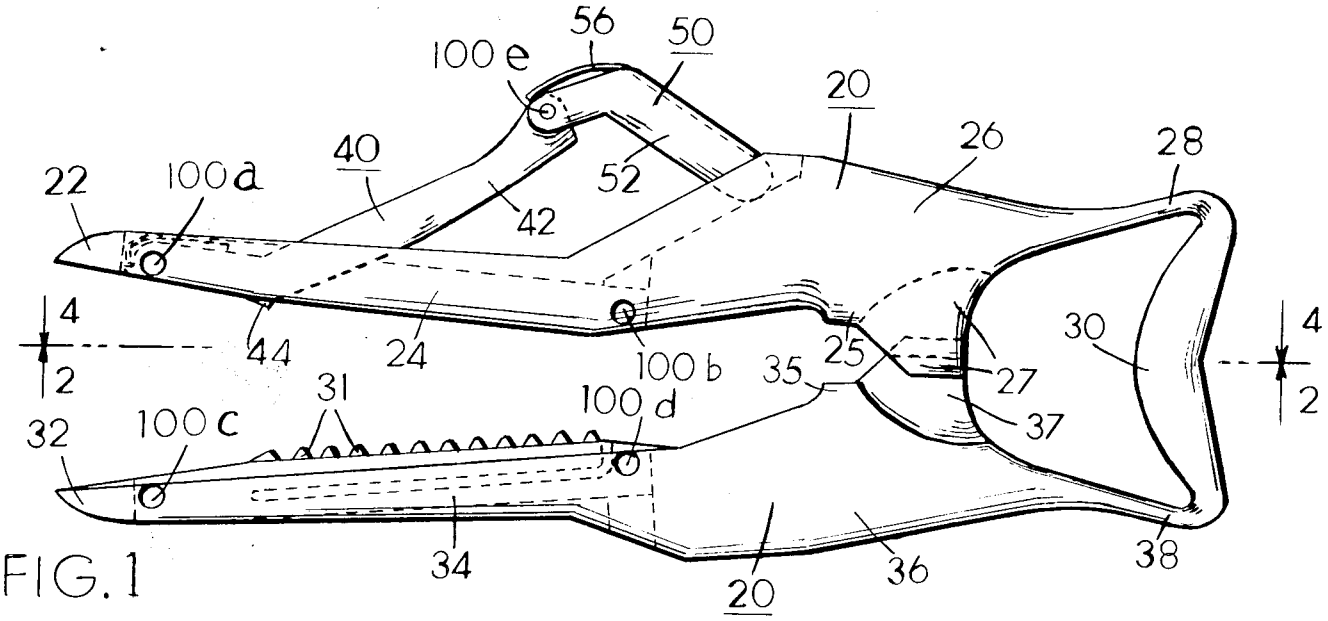
FIG. 1 is an elevation of a preferred embodiment of a hair parting and grasping cutter according to the present invention.
Figure 2:
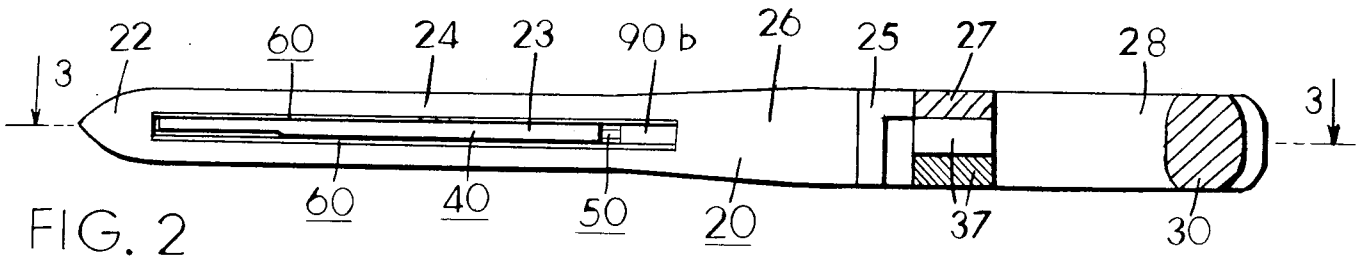
FIG. 2 is a sectional view, taken in the direction indicated by the arrows 2—2 in FIG. 1.
Figure 3:
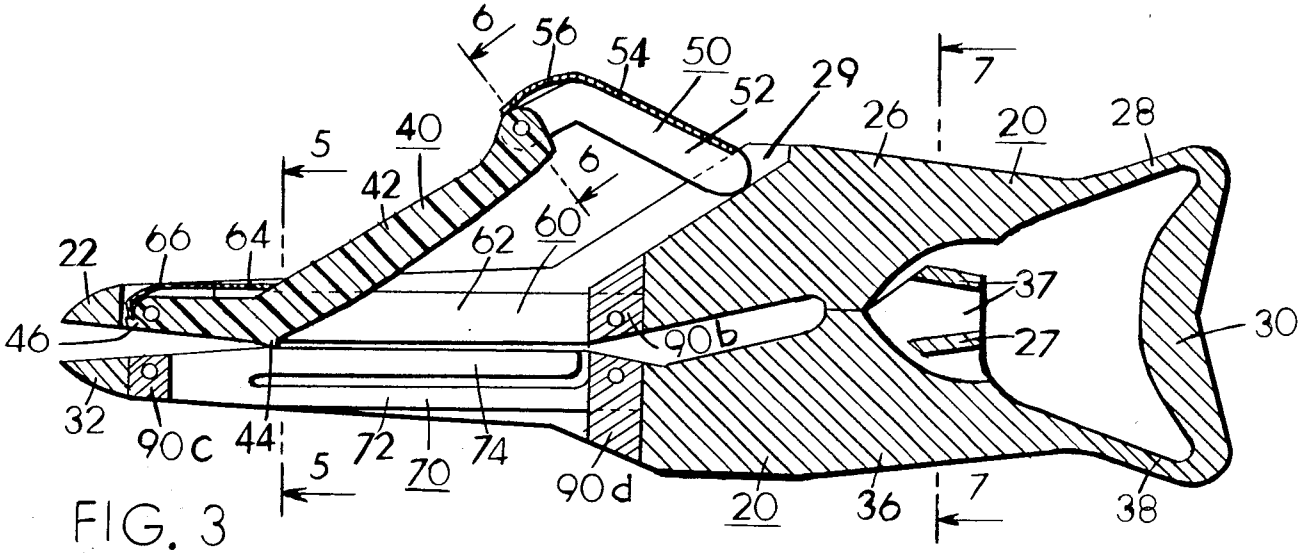
FIG. 3 is a sectional view, taken in the direction indicated by the arrows 3—3 in FIG. 2, showing such hair cutter when its frame(20) is in the fully closed position.
Figure 4:
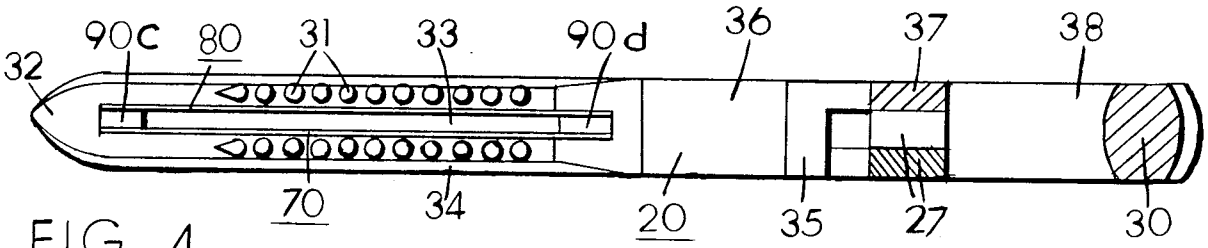
FIG. 4 is a sectional view, taken in the direction indicated by the arrows 4—4 in FIG. 1.
Figure 7:
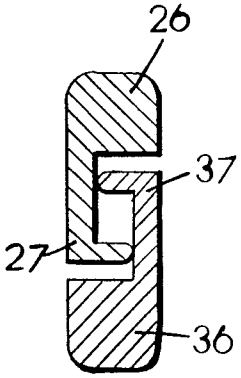
FIG. 7 is a sectional view, taken in the direction indicated by the arrows 7—7 in FIG. 3.
Figure 6:
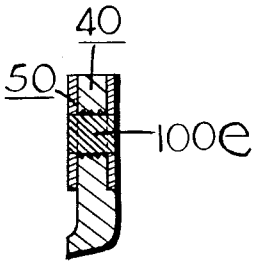
FIG. 6 is an enlarged sectional view, taken in the direction indicated by the arrows 6—6 in FIG. 3.
Figure 5:
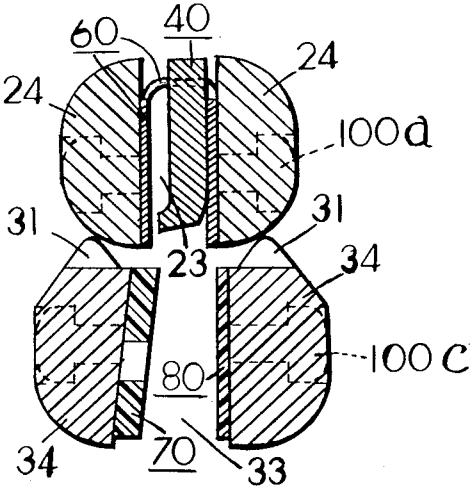
FIG. 5 is an enlarged sectional view, taken in the direction indicated by the arrows 5—5 in FIG. 3.
Figure 8:
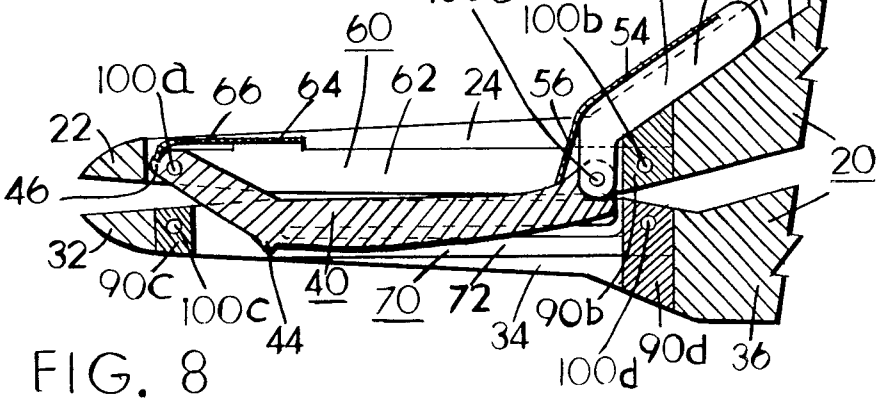
FIG. 8 is a partial view of the front part of FIG. 3, showing such hair cutter when an upper blade(40) and an actuaton(50) are in the fully closed position.

20: frame,
22, 32: front portions of the frame(20),
23, 33: slots of the frames(20),
24, 34: arm portions of the frame(20),
25, 35: closing stops of the frame(20),
26, 36: handle portions of the frame(20),
27, 37: opening stops of the frame(20),
28, 38: spring portions of the frame(20),

29: groove of the upper handle portions(26) of the frame(20),
30: rear end of the frame(20),
31: teeth of the frame(20),
40: upper shear,
42: body of the upper shear(40),
44: cusp at the front end of the blade cutting edge of the upper shear(40),
46: hook at the front end of the upper frame(40),
50: actuator for the upper shear(40),
52: sidewalls of the actuator(50),
54: upperwall of the actuator(50),
56: spring strip of the actuator(50),
60: upper shear casing,
62: sidewalls of the upper shear casing(60),
64: upperwall of the upper shear casing(60),
66: spring strip of the upper shear casing(60),
70: lower shear,
72: lower blade portion of the lower shear(70),
74: lower blade supporting portion of the lower shear(70),
80: lower support,
90: washers,
100: fasteners.

DESCRIPTION OF THE PREFERRED EMBODIMENT

With the reference now to the drawings, the preferred embodiment of the hair parting and grasping cutter of the present invention mainly comprises an elongated frame 20, an upper shear 40 and a lower shear 70. The frame 20 consists of an elongated upper portion and an elongated lower portion which are joined together at a rear end 30 of the frame. The upper and lower portions each comprises in sequence of a front portion 22, 32, an elongated arm portion 24, 34, an elongated handle portion 26, 36 and an elongated spring portion 28, 38. The front portions 22, 32 are tapering and round frontwardly pointing to the front ends of the frame 20 so as to be inserted to a person's hair smoothly in parting the hair. Two rows of teeth 31 are located along the top side of the lower arm portion 34, so that the arm portions 24, 34 are engaged to grasp the parted hair, and the teeth are adapted to comb in lifting the grasped hair. The upper arm portion 24 is provided with an elongated vertical slot 23 to receive the upper shear 40 and an upper shear casing 60. The lower arm portion 34 is provided with an elongated vertical slot 33 to receive the lower shear 70 and a lower support 80. Two sidewalls 62 of the upper shear casing 60 are fixedly attached to the sidewalls of the upper slot 23 by an upper front fastener 100*a*, an upper rear fastener 100*b* and an upper rear washer 90*b*, at near the front and rear ends of the upper slot. The upper shear 40 is pivotably attached by the upper front fastener 100*a* to slide between the sidewalls 62 of the upper shear casing 60. A spring strip 66 of the upper shear casing 60 is frontwardly projected from an upperwall 64 which is located between the upper edges of the sidewalls 62 of the upper shear casing, forming a one-piece body together. The projected end of the spring strip 66 is seated on a hook 46 located at the front end of the upper shear 40 with its spring pressure downwardly so as to force the opposite portion of the upper shear form the pivoting upper front fastener 100*a* upwardly until the upper shear is reached and stopped at the upperwall 64 of the upper shear casing 60. The bottom portion of the upper shear 40 is slightly bended having a blade cutting edge at the bended bottom end of the upper shear. The point of a cusp 44 of the upper shear 40 having the round bottom edge is located at the front end of the blade cutting edge of the upper shear. Two sidewalls 52 of an actuator 50 are pivotably attached to the rear of the upper shear 40 by an actuator's bolt 100*e*, and the rear edge of the actuator is seated on the bottom of a groove 29 located at the front side of the upper handle portion 26. A spring strip 56 of the actuator 50 is frontwardly projected from an upperwall 54 which is located between the upper edges of the sidewalls 52 of the actuator, forming a one-piece body together. The projected end of the spring strip 56 is seated on the top side of the upper shear 40 with its spring pressure downwardly so as to force the rear edge of the actuator downwardly onto the bottom of the groove 29 of the upper handle portion 26. The lower shear 70 and the lower support 80 are fixedly attached to the sidewalls of the lower slot 33 by a lower front fastener 100*c*, a lower front washer 90*c*, a lower rear fastened 100*d* and a lower rear washer 90*d*, at near the front and rear ends of the lower slot. The sidewall of the lower slot 33 attached with the lower shear 70 is oblique in vertical sectional view to have the wider space at the bottom of the lower slot. The lower blade portion 72 of the lower shear 70, which is the projected portion from the frontside of a lower blade supporting portion 74 to the rear, is slightly bended to the vertical wall of the lower slot 33. The spring portions 28, 38 are joined to the rear end 30 of the frame 20, having the spring forces of the spring portions to spread the arm portions 24, 26 until two opening stops 27, 37 of the frame 20 are locked with one another. By the squeezing strength of a user's hand onto the handle portions 26, 36 of the frame 20, the arm portions 24, 34 can be closed until two closing stops 25, 35 of the frame 20 are in contact with one another. To operate this hair cutter, first adjust the distance between the front portions 22, 32 of the frame 20 according to the desired amount of the hair to be parted and cutted, insert the front portions perpendicularly to the hair strands to part a section of the hair to be cutted, closed the arm portions 24, 34 by squeezing the handle portions 26, 36 of the frame with enough strength to hold the parted hair straight as the frame is lifted upto the desired position of the hair strands to be cutted, then to cut the hair, press the top of the actuator 50 with a tip of a finger (a forefinger or a thumb) of the same hand. The round edge of the cusp 44 of the upper shear 40 begins to overlap to the lower blade portion 72 of the lower shear 70 without being contacted with one another until the blade cutting edges of the upper and lower shears 40, 70 are overlapped and contacted with one another. The bended shape of the projected lower blade portion 72 of the lower shear 70 is engaged to provide an adequate compression to the blade cutting edges of the shears 40, 70 to cut the hair properly.

From the foregoing, it will be apparent that the hair parting and grasping cutter of the present invention is provided to facilitate the hairdressing means, such as parting, grasping, lifting and cutting the hair, by one hand operation. While the above description contains many specificities, these should not be construed as limitations on the scope of the invention, but merely as examplications of the one preferred embodiment thereof. Those skilled artisans will readily be able to change the dimentions, shape of the various embodiment and alternative materials. Accordingly, the scope of the invention should be determined not by the embodiment illustrated, but by the appended claims and their legal equivalents.

What is claimed is:

1. A hair parting and grasping cutter providing hairdressing means such as parting, grasping, lifting and cutting a person's hair by one hand operation comprising:

an elongated frame having an elongated upper portion and an elongated lower portion, each of said upper and lower portions consisting in sequence of a frontwardly pointed front portion, an elongated are portion having a vertical slot along said arm portion, an elongated handle portion providing means for stopping at the closing and opening limits thereof, and an elongated spring portion forcing to spread said upper and lower portions, joined to a real end of said frame forming a one-piece body of said frame, whereby said front portions are inserted perpendicularly to said hair to part a section of said hair, and said arm portions are closed by squeezing a user's hand on said handle portions to grasp said parted hair;

an elongated upper shear pivotable attached to near the front end of said upper arm portion within said upper slot by means for fastening members, having a blade cutting edge along the bottom edge of said upper shear;

spring member means seated between the front end of said upper shear and the rear end of said upper front portion of said frame, forcing said upper shear upwardly;

an elongated lower shear fixedly attached to a side wall of said lower slot by means for fastening members, having a blade cutting edge along the top edge of said lower shear at the corresponding side to said blade cutting edge of said upper shear, whereby the rear end of said upper shear is pressed downwardly by a finger tip of said user's hand causing said blade cutting edges of said upper and lower shears to be contacted and overlapped with one another to cut said hair therebetween.

2. A hair parting and grasping cutter as set forth in claim 1 wherein said sidewall of said lower slot being oblique in a vertical sectional view, having wider space on the bottom of said lower slot so that said lower shear is in the same oblique direction to provide more compression to said blade cutting edges as being contacted with one another to cut said hair.

3. A hair parting and grasping cutter as set forth in claim 1 wherein said upper shear having a round edged cusp at the front end of said blade cutting edge of said upper shear so that a point of said cusp begins to overlap with said lower shear without being contacted with said blade cutting edge of said lower shear to provide more smooth overlapping of said shears as said upper shear is pressed downwardly to cut said hair.

4. A hair parting and grasping cutter as set forth in claim 1 wherein a face of said upper shear concaved in the vertical direction having said blade cutting edge of said upper shear along the bottom edge of said face so as to provide more compression to said blade cutting edges as being contacted with one another to cut said hair.

5. A hair parting and grasping cutter as set forth in claim 1 wherein said lower shear having a horizontally elongated slit with an opening of said slit at the rear end of said blade cutting edge of said lower shear, and the upper portion of said lower shear above said slit incurvated in the horizontal direction within said lower slot of said frame so as to provide more compression to said blade cutting edges as being contacted with one another to cut said hair.

6. A hair parting and grasping cutter as set forth in claim 1 further comprising an elongated actuator located between said upper shear and said upper handle portion of said frame, pivotably attached to near the rear end of said upper shear by means for fastening members so as to be more convenient in actuating said upper shear by said finger tip of said user's hand.

* * * * *